United States Patent [19]

Geist et al.

[11] Patent Number: 4,496,382

[45] Date of Patent: Jan. 29, 1985

[54] PROCESS USING SERPENTINE HEAT EXCHANGE RELATIONSHIP FOR CONDENSING SUBSTANTIALLY SINGLE COMPONENT GAS STREAMS

[75] Inventors: Jacob M. Geist, Allentown; Harvey L. Vines, Emmaus; Miguel R. Alvarez, Allentown; Howard C. Rowles, Center Valley; Donald W. Woodward, New Tripoli, all of Pa.

[73] Assignee: Air Products and Chemicals, Inc., Allentown, Pa.

[21] Appl. No.: 477,200

[22] Filed: Mar. 21, 1983

[51] Int. Cl.[3] ..... F25J 1/02

[52] U.S. Cl. ..... 62/31; 62/34; 62/40

[58] Field of Search ..... 62/9, 11, 23–28, 62/31, 34, 40

[56] References Cited

U.S. PATENT DOCUMENTS

| | | | |
|---|---|---|---|
| 2,869,835 | 1/1959 | Butt | 257/245 |
| 2,940,271 | 6/1960 | Jackson | 62/31 |
| 3,225,824 | 12/1965 | Wartenberg | 165/122 |
| 3,397,460 | 10/1965 | Hall | 34/20 |
| 3,731,736 | 5/1973 | Fernandes | 165/166 |
| 3,907,032 | 9/1975 | De Groote et al. | 165/166 |
| 4,128,410 | 12/1978 | Bacon | 62/140 |
| 4,201,263 | 5/1978 | Anderson | 165/146 |
| 4,282,927 | 8/1981 | Simmons | 165/166 |

*Primary Examiner*—Frank Sever

*Attorney, Agent, or Firm*—Michael Leach; E. Eugene Innis; James C. Simmons

[57] ABSTRACT

A method is disclosed for cooling, condensing and subcooling a substantially single component gas stream by passing the gas stream through a heat exchange relationship with a vaporizing multicomponent stream so that carry-up of the condensed liquid phase is maintained without condensed phase backmixing and pot-boiling of the coolant stream is avoided. The single component gas stream is passed through a cold-end up heat exchanger having a serpentine pathway for the gas stream comprising a series of horizontal passes separated by horizontal dividers and alternatingly connected by turnaround passes at each end. The method is particularly applicable to the condensing of a recycle methane stream in a nitrogen rejection process which uses a methane heat pump cycle to provide refrigeration.

12 Claims, 2 Drawing Figures

PROCESS USING SERPENTINE HEAT EXCHANGE RELATIONSHIP FOR CONDENSING SUBSTANTIALLY SINGLE COMPONENT GAS STREAMS

TECHNICAL FIELD

The invention relates to a process for condensing a substantially single component gas stream. More particularly, the invention relates to condensing a methane gas stream in a methane heat pump cycle of a nitrogen rejection process.

BACKGROUND OF THE INVENTION

Previously, nitrogen rejection from natural gas was confined to a naturally occurring nitrogen content, thus an essentially constant feed composition. Recent methods of tertiary oil recovery utilizing nitrogen injection/rejection concepts, however, necessitate nitrogen rejection units (NRU) that can process a feed gas stream of a widely varying composition because the associated gas from the well becomes diluted by increasing amounts of injected nitrogen as the project continues. In order to sell this gas, nitrogen must be removed since it reduces the gas heating value. These nitrogen rejection processes may incorporate a methane heat pump cycle to provide refrigeration for the process and typically would use conventional heat exchangers to condense the methane gas stream.

Countercurrent heat exchange is commonly used in cryogenic processes because it is relatively more energy efficient than crossflow heat exchange. Heat exchangers of the plate-fin variety which are typically used in these processes can be configured in either a "cold-end up" or a "cold-end down" arrangement. When essentially total condensation of a gas stream is effected one approach is to use the cold-end up arrangement because "pool boiling" may occur in a cold-end down arrangement when one of the refrigerant streams comprises two or more components. Pool boiling degrades the heat transfer performance of the heat exchanger. Therefore a cold-end up arrangement is preferred. The design of such cold-end up exchangers must insure that at all points in the exchanger, the velocity of the vapor phase is high enough to carry along the liquid phase and to avoid internal recirculation, i.e. liquid backmixing which degrades the heat transfer performance of the exchanger.

However, in certain processes, such typical cold-end up heat exchangers are not adequate. There are particular problems in heat exchange situations associated with cryogenic plants for purifying natural gas streams having a variable nitrogen content. One such application in a nitrogen rejection process for which conventional heat exchange technology is inadequate involves incorporating a methane heat pump cycle into a process for treating a natural gas feed stream having a variable nitrogen content. The methane recycle must be essentially totally condensed in countercurrent heat exchange with a multicomponent vaporizing hydrocarbon stream.

As the nitrogen content gradually increases over the years, the inlet and outlet temperatures of the heat exchanger in which the methane recycle stream is condensed change. In addition, the flow rate, pressure, temperature and composition of the vaporizing hydrocarbon stream also change as the feed composition becomes progressively richer in nitrogen. These changes affect the relative positions within the heat exchanger used for cooling, condensing and subcooling the methane recycle stream. Since there is no vapor to carry over the methane liquid after the recycle stream has been condensed, the design of an operative, efficient cold-end up heat exchanger is problematical.

In order to avoid the upward stability problems that are characteristic of cold-end up exchangers, workers in the art have utilized a cold-end down approach. This approach eliminates the difficulty of carrying over the condensed liquid at the various heat exchanger operating conditions. However, the vaporizing streams in the heat exchangers which provide the condensing duty consist of at least one multicomponent hydrocarbon stream that tends to "pot boil" in cold-end down configurations. The "pot boiling" effect tends to warm up the multicomponent stream at the coldest part of the heat exchanger. To overcome this effect, the pressure of this return stream must necessarily be lowered which results in additional compression requirements and increased power consumption.

The changing conditions of the vaporizing multicomponent stream make the design of cold-end down exchangers problematical.

A worker of ordinary skill in the art of cryogenic processes can choose from a host of heat exchangers such as, for example, helically wound coil exchangers, shell and tube exchangers, plate-exchangers and others.

Illustrative of the numerous patents showing heat exchangers having a serpentine pathway for at least one fluid passing in a heat transfer relationship with another fluid are U.S. Pat. Nos. 2,869,835; 3,225,824; 3,397,460; 3,731,736; 3,907,032 and 4,282,927. None of these patents disclose the use of a serpentine heat exchanger to solve the problem of liquid backmixing associated with cold-end up heat exchangers for cooling, condensing and subcooling a methane recycle stream in a methane heat pump cycle of a nitrogen rejection process.

U.S. Pat. No. 2,940,271 discloses the use of two heat exchangers in a process scheme for the separation of nitrogen from natural gas. No mention is made of the problems associated with condensing a substantially single component gas stream against a multicomponent vaporizing hydrocarbon stream.

U.S. Pat. No. 4,128,410 discloses a gas treating unit that uses external refrigeration to cool a high pressure natural gas stream by means of a serpentine, cold-end down heat exchanger. Since the refrigerant extracts heat from the natural gas stream as the refrigerant courses through the serpentine pathway in the heat exchanger, there is no problem with stability in an upwardly condensing circuit.

U.S. Pat. No. 4,201,263 discloses an evaporator for boiling refrigerant in order to cool water or other liquids. The evaporator uses a sinuous path consisting of multiple passes on the water side of the exchanger, in which each successive pass has less area, so that the velocity of the water is increased from the first pass to the last pass.

Serpentine heat exchangers have also been used in air separation processes as a single phase subcooler, that is for cooling a liquid stream to a lower temperature without backmixing due to density differences. Another application involves supercritical nitrogen feed cooling in a nitrogen wash plant over a region of substantial change in fluid density.

SUMMARY OF THE INVENTION

The present invention involves the application of serpentine heat exchange to overcome the problem of liquid phase carry-up associated with condensing a substantially single component gas stream in upward flow against a fluid coolant stream. Where the fluid coolant stream is a multicomponent vaporizing stream, the problem of pot boiling of the coolant stream is also eliminated by vaporizing in a downward flow direction.

By a "substantially single component gas stream" we mean a gas stream which is at least 90% one component and essentially totally condenses over a narrow temperature range of less than about 10° C., preferably less than a 5° C. range.

The invention relates to a process for cooling, condensing and, optionally, subcooling a substantially single component gas stream which comprises passing the gas stream through an indirect heat exchange relationship with a fluid coolant stream, particularly a multicomponent vaporizing stream, to essentially condense the gas stream, i.e. yield a condensed and, if desirable, a subcooled liquid phase stream. The invention provides a method for cooling, condensing and subcooling the single component gas stream so that carry-up of the condensed liquid phase is maintained without condensed phase backmixing.

The method comprises passing the substantially single component gas stream through a cold-end up heat exchanger having a serpentine pathway for the single component gas stream comprising a series of horizontal passes. This method achieves stable upward flow of the essentially totally condensed gas stream. At least one coolant stream is passed through the heat exchanger in a cross- or countercurrent-flow to effect the indirect heat transfer. Preferably the coolant stream comprises a vaporizing multicomponent hydrocarbon stream.

By means of the serpentine design, the single component stream is forced alternately across and back in turnaround passes moving from one horizontal crosspath to the next. The turnaround passes allow for high velocity and high local pressure drop to insure that liquid from one crosspath does not flow back into the crosspath below. Thus by building extra pressure drop into the single component gas stream as it moves upward through the heat exchanger, the problem associated with carry-over of condensed liquid phase is alleviated.

Examples of gas streams that can be cooled in accordance with the process of the invention include such substantially single component gas streams as a methane heat pump cycle stream, a nitrogen heat pump cycle stream, and ethane or heavier hydrocarbon heat pump streams.

DETAILED DESCRIPTION OF THE INVENTION

Figure 1:
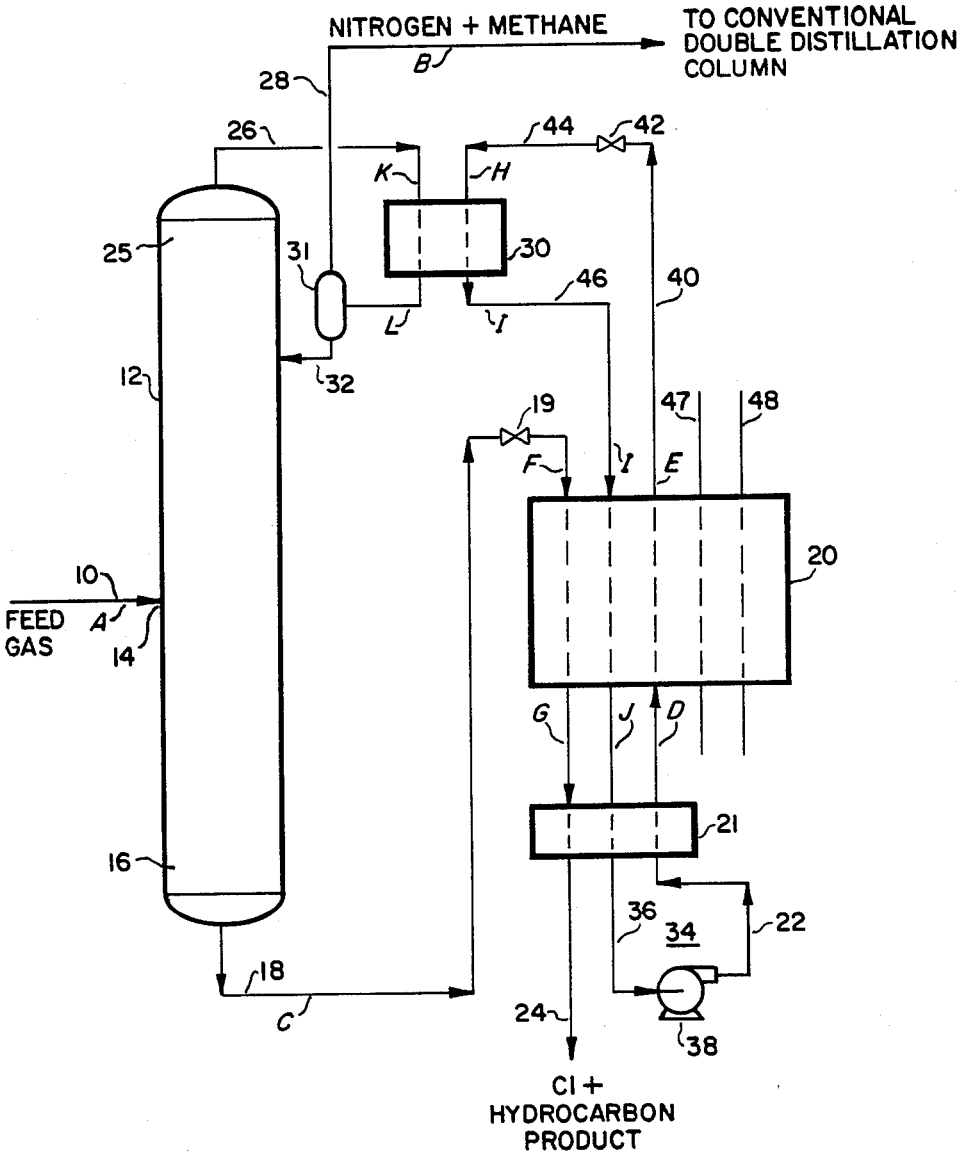
FIG. 1 is a flow diagram of an embodiment of the invention as applied to a nitrogen rejection process incorporating a methane heat pump cycle.

The method of the invention is applicable to a cryogenic nitrogen rejection process for a natural gas feed stream containing nitrogen, methane and ethane-plus hydrocarbons which process comprises cryogenically separating the natural gas stream into one or more hydrocarbon streams and a nitrogen stream and generating refrigeration for the process by means of a methane heat pump cycle. The methane heat pump cycle comprises compressing a gaseous methane stream, cooling the compressed methane stream through a heat transfer relationship with a vaporizing multicomponent hydrocarbon stream to essentially totally condense the gaseous methane stream, expanding the condensed methane stream and warming the expanded, liquid methane stream to provide the refrigeration.

A serpentine heat exchange relationship is provided for the condensing methane stream upward flow circuit in the methane cycle of the cryogenic process for nitrogen rejection from natural gas. The method of the invention provides for cooling, condensing and, optionally, subcooling the compressed substantially methane gas recycle stream which comprises passing the substantially methane stream through a cold-end up heat exchanger having a serpentine pathway for the methane gas stream comprising a series of horizontal passes separated by horizontal dividers and alternatingly connected by turnaround passes at each end so that carry-up of the condensed liquid phase is maintained without condensed phase backmixing. The methane stream is essentially totally condensed, and may be subcooled, through a heat transfer relationship with at least one fluid cooling stream which is a vaporizing multicomponent hydrocarbon stream passing in countercurrent-flow or cross-flow with the overall flow of the compressed methane recycle stream.

Preferably the heat exchange relationship also provides a cooling zone wherein the compressed methane recycle stream is cooled to a temperature above its condensation point. The cooling zone comprises a vertical pathway for the compressed methane gas stream prior to its entering the serpentine pathway where the condensation and subcooling occur.

As a result, the use of a serpentine heat exchange relationship for essentially totally condensing the compressed methane gas stream of a methane heat pump cycle in a nitrogen rejection process eliminates the need to place a conventional plate-fin heat exchanger in a cold-end down or crossflow configuration which is disadvantageous. A cold-end down configuration would result in a less efficient process as a result of the liquid phase carry-up and backmixing problems associated with the multi-component refrigerant stream. Thus, the method of the invention results in greater efficiency and operability of natural gas processing plants for nitrogen rejection.

A process for treating a natural gas stream containing methane, nitrogen and ethane-plus hydrocarbons in varying amounts which incorporates the method of the invention will now be described with reference to FIG. 1.

The natural gas feed stream in line 10 will have been treated initially in a conventional dehydration and carbon dioxide removal step to provide a dry feed stream containing carbon dioxide at a level which will not cause freeze-out on the surfaces of the process equipment. The cooled natural gas feed stream in line 10 at about −75° to −130° C. and 25 to 35 atm is charged into high pressure fractional distillation column 12 at an intermediate level 14. The natural gas stream is fractionally distilled at about 25 to 35 atm to provide a bottoms at about −80° to −90° C. containing some methane and substantially all the ethane-plus hydrocarbons. The bottoms 16 is withdrawn in line 18 and expanded at 19 to about 12 to 20 atm prior to passing through heat exchangers 20 and 21 where it is warmed to ambient temperature by the compressed gaseous methane recycle stream 22 to provide a vaporized hydrocarbon product stream 24. Heat exchanger 21 is of a conventional type for cooling the gaseous methane recycle stream 22. Heat exchanger 20 contains a serpentine pathway for condensing the gaseous methane recycle stream 22 and will be described in more detail below.

Overhead 25 of fractional distillation column 12 is withdrawn by line 26 for partial condensing in heat exchanger 30. Condensed liquid is separated in separator 31 and delivered via line 32 for reintroduction as reflux into the top of fractional distillation column 12.

Uncondensed vapor of essentially nitrogen and methane at about −95° to −150° C. is withdrawn by line 28 from the top of separator 31 for separation into its nitrogen and methane components, for example in a conventional double distillation column which comprises a high pressure distillation zone and a low pressure distillation zone, not shown.

Refrigeration for the nitrogen rejection process and particularly the condensing duty for the reflux to high pressure fractional distillation column 12 is provided by the methane heat pump cycle 34. Vapor methane stream 36, at ambient temperature and 2 to 25 atm, is compressed by methane compressor 38 to about 40 to 45 atm and is then cooled in heat exchanger 21 and condensed at about −85° to −95° C. as it courses its way through the sinuous pathway of cold-end up serpentine heat exchanger 20. The condensed methane stream 40 exiting serpentine heat exchanger 20 is expanded through valve 42 to a pressure of about 2 to 25 atm and a temperature of about −100° to −155° C. In order to provide the necessary reflux for the high pressure fractional distillation column 12, the expanded methane stream 44 is warmed against the overhead vapor stream 26 in heat exchanger 30, exiting as methane vapor stream 46. Vapor stream 46 is warmed in exchangers 20 and 21 to complete the recycle loop 34.

The diagram for serpentine heat exchanger 20 in FIG. 1 shows that other process streams 47 and 48 in the nitrogen rejection process can be passed through the heat exchanger as desired. Such additional process streams may include feed gas, product methane and reject nitrogen.

Figure 2:
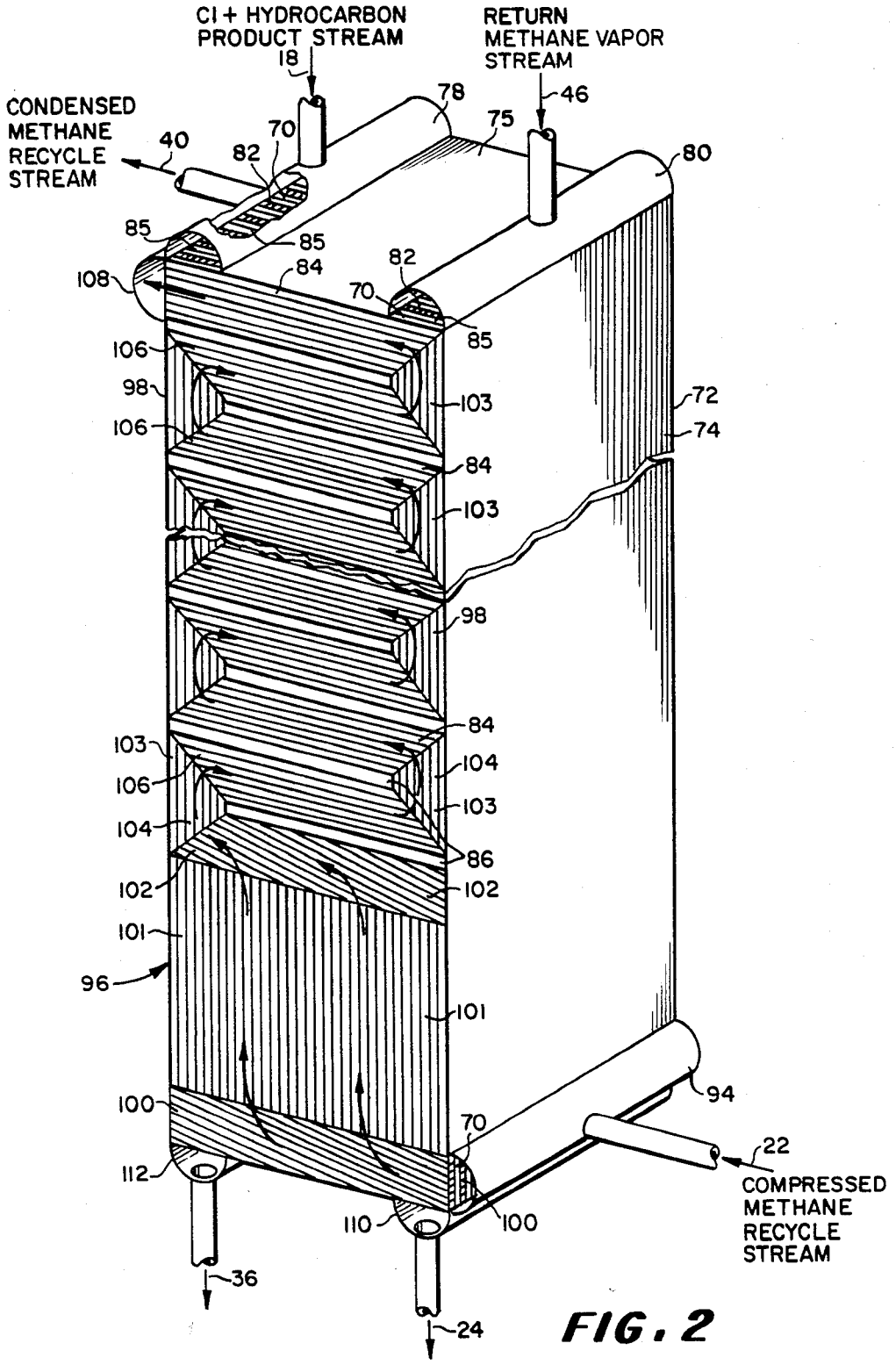
FIG. 2 is a perspective view with parts broken away to show the internal structure of a preferred serpentine heat exchanger for the inventive method as applied to the nitrogen rejection process of FIG. 1.

FIG. 2 shows a preferred serpentine heat exchanger for use in the above-described nitrogen rejection process which combines the serpentine heat exchanger 20 and the conventional heat exchanger 21 of FIG. 1 to cool and condense the recycle methane stream.

As shown in FIG. 2, the heat exchanger is essentially rectangular with a plurality of vertical parallel plates 70 of substantially the same dimensions as the front and back walls 72 positioned within the exchanger for the entire length of sidewalls 74. It is preferred that the plates 70 be of a metal such as aluminum having good heat transfer characteristics and capable of withstanding low temperatures. Extending across the top of the heat exchanger for its full depth is top wall 75 and tunnel-shaped headers 78 and 80, the methane-plus hydrocarbon product stream header and the return methane vapor stream header, respectively.

In the space between some of the vertical plates 70 are corrugated metallic inserts 82 having their ridges running vertically through the heat exchanger. In the space between other plates 70 are corrugated inserts 84 having their ridges extending horizontally through the heat exchanger. Inserts 82 and 84 may comprise plate fins, such as perforated, serrated, and herringbone plate fins. The inserts 82 and 84 are in alternate spaces between plates 70 in each vertical section of heat exchanger 20. The inserts act as distributors for fluids flowing through the heat exchanger and aid in the conduction of heat to or from the plates 70. Closing off the spaces between vertical plates 70 which do not contain inserts 82 are covers 85 sealing off those spaces containing horizontal inserts 84. Although not depicted in FIG. 2, vertical inserts 82 also comprise a distribution section which provides diagonal pathways leading from headers 78 and 80 and spreading over the entire width of the spaces between plates 70 thereby distributing the methane-plus hydrocarbon product stream 18 and the return methane vapor stream 46 from the respective headers throughout the width of the exchanger. Alternatingly extending from each sidewall 74 through most of the space between plates 70 in which there are inserts 84 are horizontal dividers 86 which guide the methane stream through the heat exchanger in a series of horizontal passes, as hereinafter described.

On the lower end of the heat exchanger is a compressed methane recycle stream header 94 which directs the compressed methane recycle stream 22 into the cooling section 96 connected to the sinuous pathway, generally designated as 98, at its lower warm-end, i.e. upstream of the sinuous pathway. Cooling section 96 comprises the same alternating spaces between plates 70 that contain inserts 84 of sinuous pathway 98, i.e. cooling section 96 communicates with the sinuous pathway section. Cooling section 96 has distributor fins or panels 100, which connect inlet methane recycle stream header 94 with vertical inserts 101 of cooling section 96, and distributor panels 102 which connect vertical inserts 101 with first internal turnaround section 103 containing vertical panels 104. Thus a substantially vertical cooling pathway is provided for the compressed methane recycle stream 22 prior to entering the serpentine section where condensation occurs.

The uppermost horizontal pathway 106 which is defined by top wall 75 and covers 85 on the top, upper most divider 86 on the bottom and plates 70 on either side discharges into condensed methane recycle stream outlet header 108 which is connected to line 40.

A methane-plus hydrocarbon product stream outlet header 110 and a return methane vapor stream outlet header 112 across the bottom of the heat exchanger each seal against a sidewall and the bottom of the heat exchanger. The methane-plus hydrocarbon product stream 18 is delivered for warming as a vaporizing stream in the heat exchanger in those spaces between plates 70 having inserts 82 permitting flow vertically from inlet header 78 to outlet header 110. The methane return vapor stream 46 is warmed as it passes through the heat exchanger in those spaces between plates 70 having inserts 82 permitting flow vertically from inlet header 80 to outlet header 112.

Compressed, recycle methane enters the heat exchanger through line 22 and header 94 and flows through the spaces between plates 70 in which there are distributor fins 100, vertical inserts 101, distributor fins 102, vertical inserts 104 in turnarounds 103, and horizontally ridged inserts 84. The methane recycle stream flows diagonally upward across the heat exchanger between distributor fins 100, then vertically through vertical inserts 101 and diagonally upward again between distributor fins 102 into the first, or lower most, turnaround 103. Since the vertical inserts 104 of each turnaround 103 angularly connect with horizontal inserts 84, the effect on the methane recycle stream is to reverse its horizontal flow direction in each turnaround 103 while also advancing it vertically. Thus, the overall flow of the methane recycle stream is vertical from line 22 to line 40 and is countercurrent to the flow of the methane-plus hydrocarbon product stream and the return methane vapor stream, but the vertical flow is accomplished in part in a series of horizontal passes 106 in a crossflow manner.

The cross-sectional area of the horizontal, or cross, passes 106 is of significant importance to the invention in order to achieve a reasonable overall pressure drop while providing sufficient cross-flow passes for efficient heat transfer. In a heat exchanger in which the cross-section of the serpentine pathway is a rectangle and the depth of the pathway is constant, the cross-sectional area is directly proportional to the height. Thus, the use of either "cross-sectional area" or "height" when referring to horizontal passes implies the other.

As shown in FIG. 2, the height of the horizontal passes 106 defined by horizontal dividers 86 may all be of the same height, or in particular situations the height of horizontal passes nearer the cold-end of the heat exchanger, as in a subcooling section, may be less than the height of the horizontal passes nearer the warm-end. The width of the turnaround sections 103 is critical, since they must provide sufficient local pressure drop to prevent backmixing of condensed liquid phase from higher, colder horizontal passes to lower, warmer horizontal passes.

In any particular case the height of the passes and the width of the turnarounds can be readily calculated by using standard pressure drop and flow regime equations.

In the following examples relating to nitrogen rejection from a variable content natural gas stream at various nitrogen concentrations, the data presented were calculated based on a serpentine heat exchanger as shown in FIG. 2 being 240 inches overall length (divided between the serpentine section 98 and the cooling section 96), 36 inches width and 48 inches stacking height. The serpentine pathway comprises 12 sinuous passages between plates 70, each sinuous passage having 12 horizontal passes of 9 inches in height (horizontal dividers are 1 inch thick) and turnarounds of 4 inches in width. For the vaporizing methane-plus hydrocarbon product stream there are provided 36 vertical passages and for the methane return vapor stream there are 24 vertical passages between plates 70 alternating with the serpentine passages.

It should be readily obvious to a worker of ordinary skill in the art that the described serpentine heat exchanger could also be designed to accommodate other streams for cooling or warming in addition to the methane-plus hydrocarbon product stream and the return methane vapor stream by appropriately blocking off some of the spaces between the vertical plates 70 and providing the appropriate headers. In a like manner other streams which are to be cooled can be passed through some of the vertical heat exchange passages, or through serpentine passages of similar or different design.

EXAMPLE 1

Tabulated in Table 1 are the calculated overall balances corresponding to the heat and material balance points A–L as designated in FIG. 1. In this case the natural gas feed stream contains about 5% nitrogen.

TABLE 1

5% $N_2$ Feed

| STREAM | TEMP DEG F. | TEMP (C.) | PRES PSIA | PRES (ATM) | TOTAL FLOW LBMOL/HR | COMPONENT FLOW RATES LBMOL/HR $N_2$ | C1 | C2+ |
|---|---|---|---|---|---|---|---|---|
| A | −100 | (−79) | 490 | (33.3) | 4000 | 200 | 3268 | 532 |
| B | −144 | (−98) | 490 | (33.3) | 1352 | 168 | 1184 | 0.0 |
| C | −120 | (−84) | 493 | (33.5) | 2648 | 32 | 2084 | 532 |
| D | −123 | (−86) | 610 | (41.5) | 2600 | 28 | 2572 | 0.0 |
| E | −134 | (−92) | 600 | (40.8) | 2600 | 28 | 2572 | 0.0 |
| F | −153 | (−103) | 260 | (17.7) | 2648 | 32 | 2084 | 532 |
| G | −136 | (−93) | 255 | (17.4) | 2648 | 32 | 2084 | 532 |
| H | −151 | (−102) | 373 | (25.4) | 2600 | 28 | 2572 | 0.0 |
| I | −150 | (−101) | 371 | (25.2) | 2600 | 28 | 2572 | 0.0 |
| J | −136 | (−93) | 368 | (25.0) | 2600 | 28 | 2572 | 0.0 |
| K | −140 | (−96) | 492 | (33.5) | 4032 | 308 | 3724 | 0.0 |
| L | −144 | (−98) | 490 | (33.3) | 4032 | 308 | 3724 | 0.0 |

EXAMPLE 2

In this case the natural gas feed stream contains about 18% nitrogen and Table 2 shows the calculated overall heat and material balance for points A–L.

TABLE 2

80% $N_2$ Feed

| STREAM | TEMP DEG F. | TEMP (C.) | PRES PSIA | PRES (ATM) | TOTAL FLOW LBMOL/HR | COMPONENT FLOW RATES LBMOL/HR $N_2$ | C1 | C2+ |
|---|---|---|---|---|---|---|---|---|
| A | −198 | (−128) | 400 | (27.2) | 4000 | 3200 | 500 | 300 |
| B | −234 | (−148) | 400 | (27.2) | 3372 | 3188 | 184 | 0.0 |
| C | −119 | (−84) | 403 | (27.4) | 628 | 12 | 316 | 300 |
| D | −123 | (−86) | 610 | (41.5) | 2960 | 28 | 2932 | 0.0 |
| E | −124 | (−87) | 600 | (40.8) | 2960 | 28 | 2932 | 0.0 |
| F | −145 | (−98) | 200 | (13.6) | 628 | 12 | 316 | 300 |

TABLE 2-continued

| | 80% $N_2$ Feed | | | | | | | |
|---|---|---|---|---|---|---|---|---|
| | TEMP | | PRES | | TOTAL FLOW | COMPONENT FLOW RATES LBMOL/HR | | |
| STREAM | DEG F. | (C.) | PSIA | (ATM) | LBMOL/HR | $N_2$ | C1 | C2+ |
| G | −133 | (−92) | 198 | (15.5) | 628 | 12 | 316 | 300 |
| H | −240 | (−151) | 32 | (2.2) | 2960 | 28 | 2932 | 0.0 |
| I | −239 | (−151) | 32 | (2.2) | 2960 | 28 | 2932 | 0.0 |
| J | −133 | (−92) | 29 | (2.0) | 2960 | 28 | 2932 | 0.0 |
| K | −230 | (−146) | 402 | (27.3) | 6052 | 5532 | 520 | 0.0 |
| L | −234 | (−148) | 400 | (27.2) | 6052 | 5532 | 520 | 0.0 |

From the above description of a preferred embodiment of the invention for cooling a substantially single component gas stream to provide an essentially totally condensed phase, it can be seen that a method is disclosed for providing the necessary pressure drop and minimum gas velocity to carry the condensed liquid phase upwardly through a cold-end up heat exchange relationship with at least one vaporizing multicomponent stream as the coolant stream. By the use of a cold-end up serpentine heat exchanger having a sinuous pathway for the single component gas stream which is to be condensed, the problem of carry-up is only encountered in the turn around passes, not in the horizontal passes, thus reducing the carry-up problem to a small fraction of the total cooling pathway in which condensation occurs and rendering it manageable. As a further advantage of the serpentine heat exchanger shown and described above, a preliminary cooling of the single component gas stream may be effected in vertical passes prior to entering the serpentine section of the heat exchanger.

Pot boiling of the multicomponent coolant stream is also eliminated by vaporizing in a downward flow direction.

STATEMENT OF INDUSTRIAL APPLICATION

The invention provides a method for maintaining upward stability of a single component gas stream as it is cooled and condensed through a cold-end up heat exchange relationship with a coolant stream comprising a vaporizing multicomponent stream whereby backflow of condensed phase and pot-boiling of the coolant stream are avoided. The method of the invention has particular application to a nitrogen rejection process which incorporates a methane heat pump cycle to provide refrigeration.

We claim:

1. In a process for cooling and condensing a substantially single component gas stream which comprises passing the gas stream through a heat exchange relationship with a fluid coolant stream which is a vaporizing multicomponent stream to yield a condensed substantially single component liquid stream, the method which comprises precluding condensed phase backmixing of the substantially single component stream and pot boiling of the multicomponent coolant stream by passing the single component gas stream through a serpentine pathway containing a series of horizontal passes in a cold-end up heat exchange relationship with the vaporizing multicomponent coolant stream.

2. The method of claim 1 wherein the single component gas stream is first passed through a cooling section having vertical passages in a heat exchange relationship with the vaporizing multicomponent coolant stream and communicating at its outlet with the warm-end of the serpentine pathway.

3. The method of claim 1 wherein the cross-sectional areas of the horizontal passes are about equal.

4. The method of claim 1 wherein the cross-sectional areas of the horizontal passes nearer the cold-end are of lesser cross-sectional area then the horizontal passes nearer the warm-end.

5. In a cryogenic nitrogen rejection process for a natural gas feed stream containing nitrogen, mathane and ethane-plus hydrocarbons which comprises cryogenically separating the natural gas stream into at least one hydrocarbon stream and a nitrogen stream and providing refrigeration for the process by means of a methane heat pump cycle which comprises compressing a methane stream, cooling the compressed methane stream through a heat exchange relationship with a vaporizing multicomponent hydrocarbon stream to essentially totally condense the methane stream, expanding the condensed methane stream and warming the expanded methane stream to provide refrigeration, the method for treating a natural gas stream containing a variable composition, which method comprises precluding condensed phase backmixing of the compressed methane stream and pot boiling of the vaporizing multicomponent hydrocarbon coolant stream by passing the compressed methane stream through a serpentine pathway containing a series of horizontal passes in a cold-end up heat exchange relationship with the vaporizing multicomponent hydrocarbon stream.

6. The method of claim 5 wherein the compressed methane stream is first passed through a cooling section having vertical passages in a heat exchange relationship with the vaporizing multicomponent hydrocarbon stream and communicating at its outlet with the warm-end of the serpentine pathway.

7. The method of claim 5 wherein the cross-sectional areas of the horizontal passes are about equal.

8. The method of claim 5 wherein the cross-sectional areas of the horizontal passes nearer the cold-end are of lesser cross-sectional area then the horizontal passes nearer the warm-end.

9. The method of claim 5 wherein the heat pump cycle fluid is nitrogen.

10. In a nitrogen rejection unit comprising a fractional distillation column for separating a natural gas feed stream into a multicomponent hydrocarbon bottoms stream and a nitrogen and methane overhead stream, a double distillation column which comprises a high pressure distillation zone and a low pressure distillation zone for separating the overhead stream from the fractional distillation column into a nitrogen stream and a methane stream, and a methane heat pump cycle for providing refrigeration for the nitrogen rejection unit, which methane cycle includes means for cooling the compressed methane recycle stream through a heat exchange relationship with the multicomponent hydrocarbon stream, the improvement which comprises means designed, sized and arranged for precluding condensed phase backmixing of the compressed methane stream and pot boiling of the vaporizing multicomponent hydrocarbon stream comprising a cold-end up heat exchanger having a serpentine pathway containing a series of horizontal passes for cooling and condensing the methane recycle stream of the methane heat pump cycle in an overall upward flow against the multicomponent hydrocarbon stream.

11. The nitrogen rejection unit of claim 10 in which the cross-sectional areas of the horizontal passes in the serpentine heat exchanger are about equal.

12. The nitrogen rejection unit of claim 10 in which the cross-sectional areas of the horizontal passes nearer the cold-end in the serpentine heat exchanger are of lesser cross-sectional area than the horizontal passes nearer the warm-end.

* * * * *